US009803953B1

(12) United States Patent
Lai

(10) Patent No.: US 9,803,953 B1
(45) **Date of Patent: *Oct. 31, 2017**

(54) MECHANICAL PAINTBALL GUN

(71) Applicant: Bao Shyan Lai, Taichung (TW)

(72) Inventor: Bao Shyan Lai, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/414,826

(22) Filed: Jan. 25, 2017

Related U.S. Application Data

(63) Continuation-in-part of application No. 15/281,573, filed on Sep. 30, 2016.

(51) Int. Cl.

| | |
|---|---|
| ***F41B 11/642*** | (2013.01) |
| ***F41B 11/723*** | (2013.01) |
| ***F41B 11/73*** | (2013.01) |
| ***F41B 11/70*** | (2013.01) |

(52) U.S. Cl.
CPC ..... *F41B 11/642* (2013.01); *F41B 11/70* (2013.01); *F41B 11/723* (2013.01); *F41B 11/73* (2013.01)

(58) Field of Classification Search
CPC ..... F41B 11/721; F41B 11/00; F41B 11/52; F41B 11/642; F41B 11/70; F41B 11/723
See application file for complete search history.

(56) References Cited

U.S. PATENT DOCUMENTS

| | | | | |
|---|---|---|---|---|
| 5,413,083 | A * | 5/1995 | Jones | F41B 11/52 124/32 |
| 2003/0079731 | A1* | 5/2003 | Dobbins | F41B 11/52 124/76 |
| 2003/0168052 | A1* | 9/2003 | Masse | F41B 11/57 124/73 |
| 2004/0065310 | A1* | 4/2004 | Masse | F41B 11/57 124/75 |
| 2005/0268894 | A1* | 12/2005 | Styles | F41B 11/68 124/74 |
| 2009/0241931 | A1* | 10/2009 | Masse | F41B 11/62 124/76 |

* cited by examiner

*Primary Examiner* — Benjamin P Lee
(74) *Attorney, Agent, or Firm* — C. G. Mersereau; Nikolai & Mersereau, P.A.

(57) ABSTRACT

A mechanical paintball gun has a first operation chamber and a second operation chamber for receiving a firing piston and a hammer, respectively. The firing piston and the hammer move simultaneously between a first position status and a second position status. The second operation chamber is connected with a high-pressure gas source and has a normally closed valve pack. When the hammer moves to the second position status, the valve pack becomes open and allows high-pressure gas to pass therethrough to enter the first operation chamber for shooting paintballs. The second operation chamber contains therein a slidable member and a resistance device. The slidable member is linked with the hammer, and the slidable member pushes the resistance device. With the resistance device slowing down the slidable member to delay a cycle time of a shooting process, paintballs can be fed in time to enable continuous and stable shooting.

15 Claims, 15 Drawing Sheets

MECHANICAL PAINTBALL GUN

CROSS-REFERENCE TO RELATED APPLICATIONS

The present application is a continuation-in-part of U.S. patent application Ser. No. 15/281,573, filed on Sep. 30, 2016, titled Mechanical Paintball Gun Capable of Continuously Shooting, listing Bao Shyan Lai as inventor. The above application is incorporated herein by reference in its entirety.

BACKGROUND OF THE INVENTION

1. Field of the Invention

The present invention relates to paintball guns, and more particularly to a mechanical paintball gun capable of continuously shooting paintballs.

2. Description of the Related Art

Please refer to FIG. 15 which shows a conventional mechanical paintball gun. In the conventional mechanical paintball gun, a percussion zone 91 is disposed in a barrel 9, and a paintball 5 is ejected out of a bullet cartridge to be fed into the percussion zone 91 for being shot by a firing piston 92. The firing piston 92 is driven to move by a spring 921 and high-pressure gas, and a player can actively actuate the firing piston 92 by a trigger 93. When the player pulls the trigger 93, a stop member 94 is acted simultaneously with the trigger 93 to separate from the firing piston 92, and the firing piston 92 is then pushed out by the spring 921 to forwardly impact and open a valve pack 95. that the paintball 5 can be shot in high speed and, at the same time, the firing piston 92 is pushed backwardly to its original position to be blocked and positioned by a stop member 94. In the process of shooting the paintball 5, the firing piston 92 is driven by both of the spring 921 and the high-pressure gas to complete a reciprocation stroke in a cycle.

However, the conventional mechanical paintball gun can only perform a single shot one time by the aforementioned operation. In the event that the player keeps pulling the trigger 93 for continuously shooting, the firing piston 92 is repeatedly driven by the spring 921 and the high-pressure gas to perform reciprocation stroke for many times while not being blocked by the stop member 94. However, the cycle time for the firing piston 92 to complete one stroke is so short that a successive shooting action is likely to be performed before a refill paintball is fed into the percussion zone 91. In this case, for the successive shooting action, the paintball 5 would be pressed by the firing piston 92 to burst in the barrel 9, which results in failure of the shooting paintball 5 and even breakage of the paintball gun.

SUMMARY OF THE INVENTION

In view of this, one primary objective of the present invention is to provide a mechanical paintball gun. The mechanical paintball gun comprises a delay mechanism to increase a cycle time for a firing piston to complete a stroke, whereby there is enough time for a paintball to completely enter a percussion zone, thereby preventing the paintball from bursting inside the paintball gun while the mechanical paintball gun is operated to shoot continuously.

For achieving the foregoing objective, the present invention provides a mechanical paintball gun that comprises a frame comprising a barrel formed with a first operation chamber and a second operation chamber, and a firing piston slidably disposed in the first operation chamber, and a hammer slidably disposed in the second operation chamber and elastically pushed by a spring. The firing piston and the hammer are linked with each other to move simultaneously between a first position status and a second position status. The first operation chamber has a ball feeding hole, and a portion, which corresponds in position to the ball feeding hole, defined as a percussion zone. The second operation chamber is in communication with a high-pressure gas source and has a valve pack which is normally closed, and the valve pack passes the high-pressure gas therethrough when the valve pack is pushed by the hammer at the second position status. The frame has a ventilation hole in communication with the first operation chamber and the second operation chamber, the firing piston has an outlet channel, and the outlet channel is in communication with the ventilation hole when the firing piston is at the second position status. The frame includes a stop member, which normally locks the hammer at the first position status, and is linked with a trigger. The trigger is pivotally swingable and when swung it separates the stop member from the hammer, thereby relieving the hammer from locking. The mechanical paintball gun further has the following characteristics:

the frame including a delay mechanism configured to increase a cycle time of a shooting process, the delay mechanism including an extension tube corresponding to the second operation chamber, a slidable member and a resistance device being disposed in the extension tube, the slidable member being connected with the hammer so that the slidable member and the hammer move simultaneously between the first position status and the second position status, and the slidable member such abutting against the resistance device that the resistance device provides resistance to the slidable member.

The resistance device comprises:

a toggle gear abutting against a toggle that is pivotally connected with the slidable member and configured to poke the toggle gear according to movement of the slidable member;

a resistance gear linked with the toggle gear and configured to rotate with the toggle gear; and an obstruction member abutting against the resistance gear so as to provide rotational resistance against the resistance gear.

In one embodiment, the toggle gear and the resistance gear are disposed coaxially.

In one embodiment, the obstruction member is pivotally disposed in the extension tube, and has its two ends formed with abutting parts, respectively. The two abutting parts are configured to abut against a tooth edge of the resistance gear alternately while the obstruction member is pivotally swung.

In one embodiment, a constraint member is disposed in the extension tube and configured to lock the toggle gear, such that the toggle gear is poked by the toggle just unidirectionally when the slidable member is moved from the first position status to the second position status.

In one embodiment, the resistance gear further comprises at least one raised post, and an auxiliary trigger pivotally disposed in the extension tube has an interlocking bar linked to the trigger. A swing arm is pivotally disposed in the extension tube and has its first end extending toward the auxiliary trigger. The first end is configured to be pushed by the auxiliary trigger and in turn make the swing arm swing between a first swing position and a second swing position. The first end has a stopping portion. When the swing arm is at the first swing position, the stopping portion stops the raised post and limits a rotational stroke of the resistance gear. When the swing arm is at the second swing position, the stopping portion forms no obstruction against the raised post.

In one embodiment, the toggle gear and the resistance gear are linked by a transmission gear set. The transmission gear set comprises a first gear disposed coaxially with the toggle gear, and a second gear disposed coaxially with the resistance gear. The first gear and the second gear are engaged with each other. Further, the second gear is dimensionally smaller than the first gear.

Moreover, the first gear further comprises at least one raised post, and an auxiliary trigger pivotally disposed in the extension tube has an interlocking bar linked to the trigger. A swing arm is pivotally disposed in the extension tube and has its first end extending toward the auxiliary trigger. The first end is configured to be pushed by the auxiliary trigger and in turn make the swing arm swing between a first swing position and a second swing position. The first end has a stopping portion. When the swing arm is at the first swing position, the stopping portion stops the raised post and limits a rotational stroke of the first gear. When the swing arm is at the second swing position, the stopping portion forms no obstruction against the raised post.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE PREFERRED EMBODIMENTS

Figure 1:
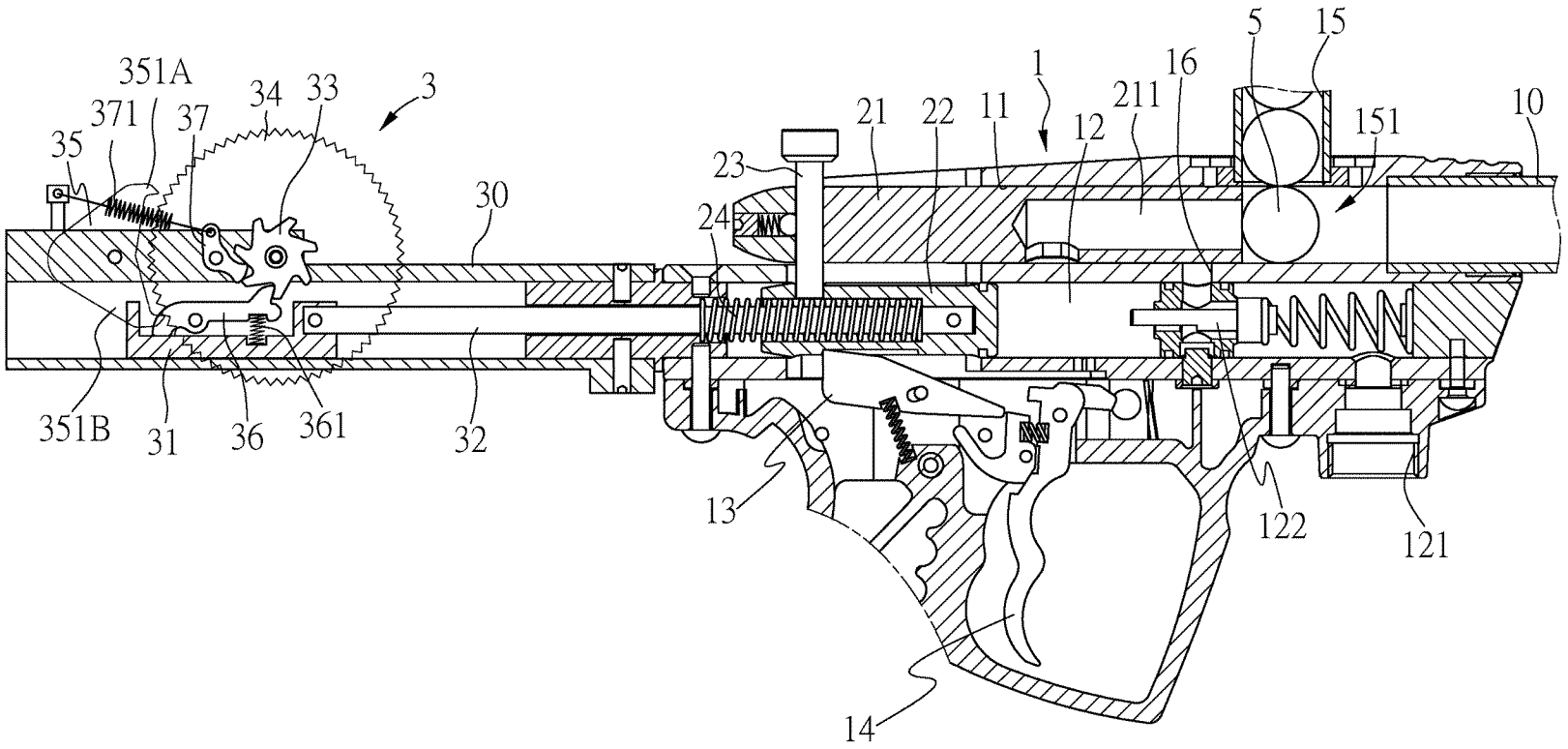
FIG. 1 is a cross-sectional schematic view of a paintball gun according to a first embodiment of the present invention.
Figure 3:
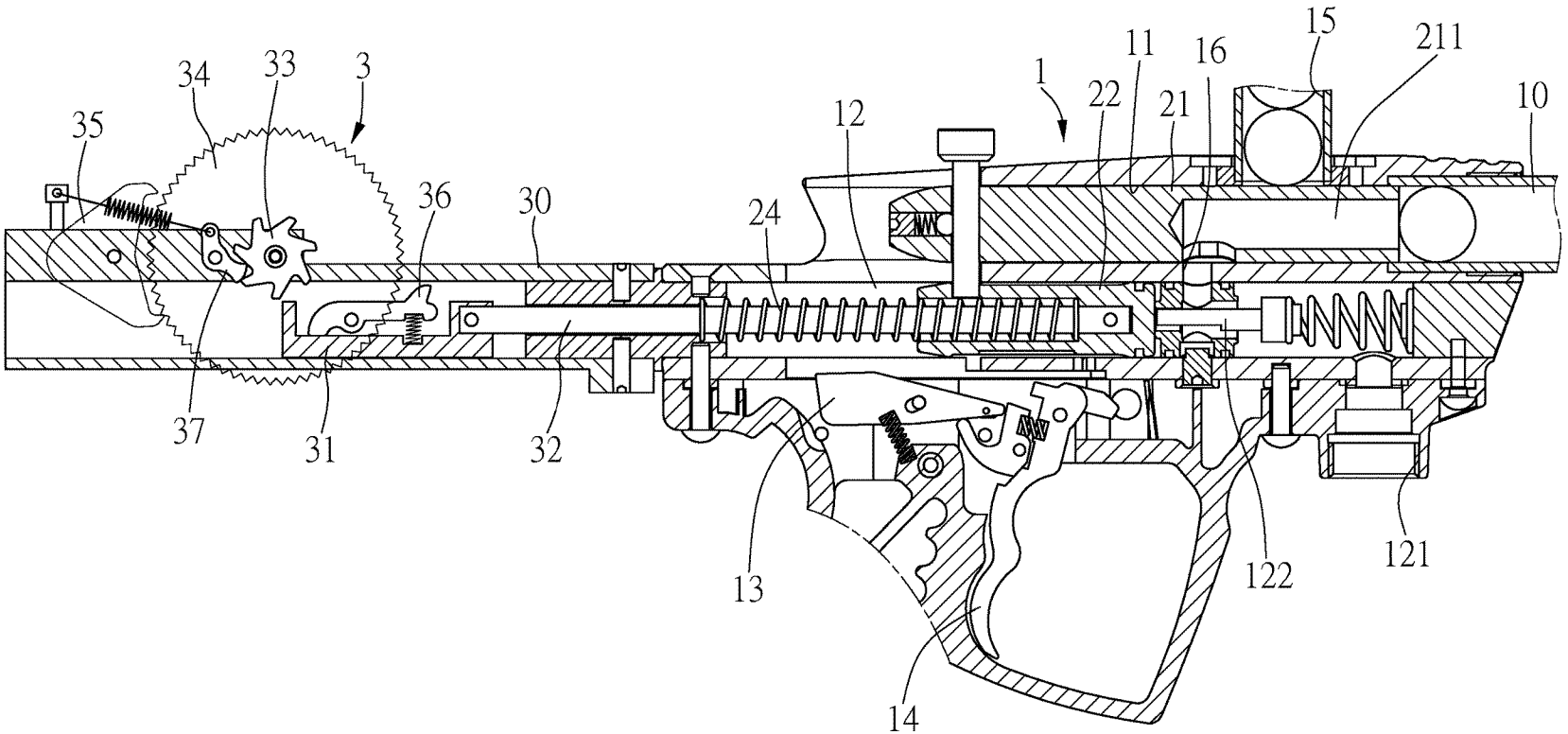
FIG. 3 is a cross-sectional schematic view showing a middle-stage operation of the paintball gun of the first embodiment of the present invention, during the shooting process.

Please refer to FIG. 1, which shows a mechanical paintball gun according to the first embodiment of the present invention. The mechanical paintball gun comprises a frame 1, which includes a barrel 10. A first operation chamber 11 and a second operation chamber 12 are formed in the frame 1 and parallel to each other. The first operation chamber 11 contains a firing piston 21 that is slidable and corresponding to the barrel 10. The second operation chamber 12 contains a hammer 22. The firing piston 21 and the hammer 22 are linked by a first linking member 23, so that the two can move simultaneously in the first operation chamber 11 and in the second operation chamber 12, respectively. Therein, the hammer 22 is biased by a first spring 24, and when pushed, makes the firing piston 21 and the hammer 22 move from a first position status as shown in FIG. 1 to a second position status as shown in FIG. 3.

A stop member 13 is pivotally disposed inside the frame 1 to normally lock the hammer 22 at the first position status. The stop member 13 is linked to a swingable trigger 14, which is configured to swing when operated by a player and in turn make the stop member 13 leave from the hammer 22, thereby unlocking the hammer 22. The unlocked hammer 22 is then pushed by the first spring 24 and moves to the second position status.

The first operation chamber 11 has a ball feeding hole 15 located in front of the firing piston 21 (that is, a position close to a muzzle) and configured to be in communication with the bullet cartridge. A portion of the first operation chamber 11 corresponding in position to the ball feeding hole 15 is defined as a percussion zone 151, and the paintball 5 moved out from the bullet cartridge is fed into the percussion zone 151 through the ball feeding hole 15.

Figure 4:
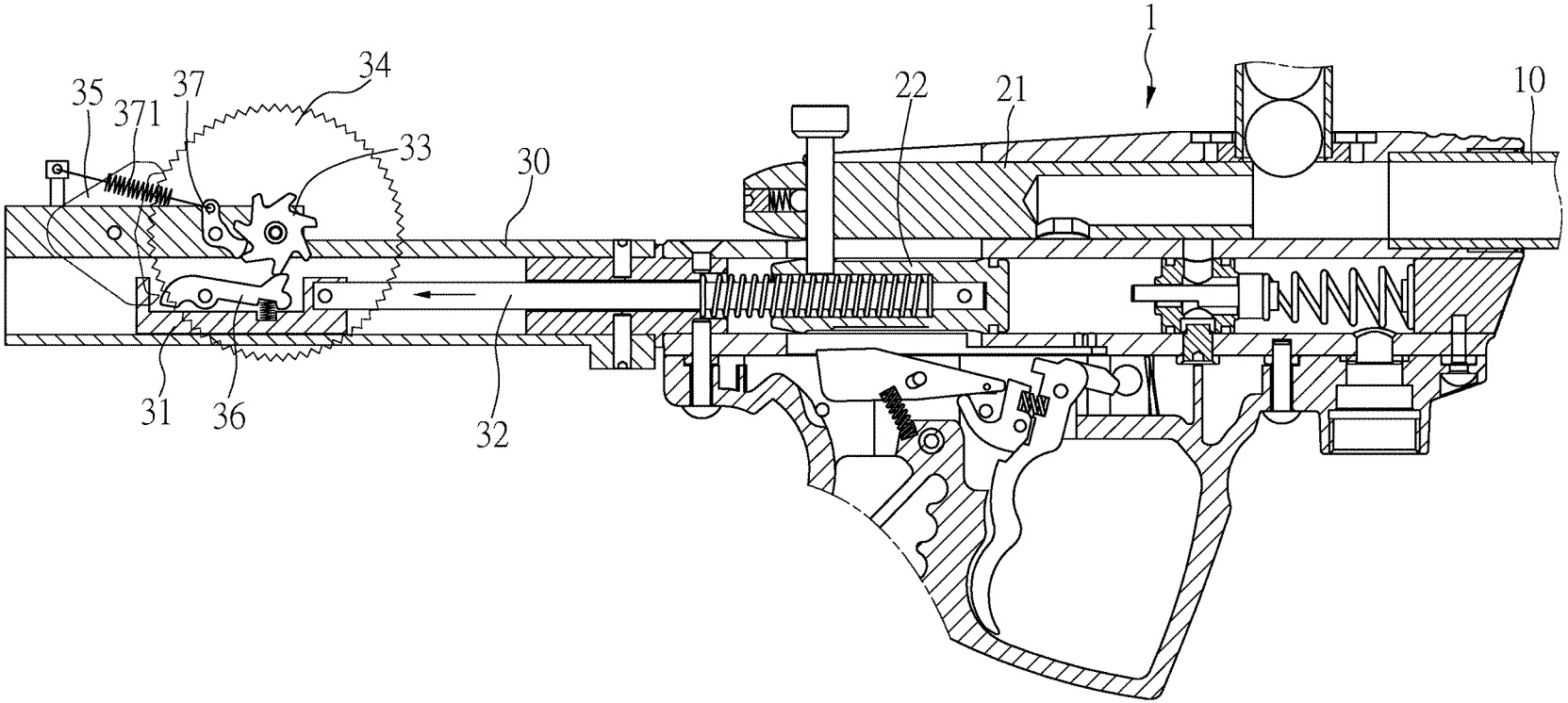
FIG. 4 is a cross-sectional schematic view showing a late-stage operation of the paintball gun of the first embodiment of the present invention, during the shooting process.

The second operation chamber 12 is in communication with a high-pressure gas source (not shown in figures) through a connecting hole 121, such that the high-pressure gas is injected into the second operation chamber 12. The second operation chamber 12 has a valve pack 122 which is normally-off. The valve pack 122 is pushed to pass the high-pressure gas therethrough when the hammer 22 is moved to the second position status shown in FIG. 3. On the other hand, the frame 1 includes a ventilation hole 16 in communication with both of the first operation chamber 11 and the second operation chamber 12, and the firing piston 21 has an outlet channel 211 formed inside. When the firing piston 21 is moved to the second position status, the outlet channel 211 is to be in communication with the ventilation hole 16, such that the first operation chamber 11 and the second operation chamber 12 are in communication with each other. At this time, the high pressure gas is injected into the operation chamber 11 through the outlet channel 211, to shoot the paintball outside the percussion zone 151 at high speed. While the valve pack 122 is opened, the high-pressure gas also pushes the hammer 22 to move from the second position status to the first position status. As shown in FIG. 4, when the hammer 22 is separated from the valve pack 122, the valve pack 122 is closed correspondingly.

In conclusion, during the process of shooting the paintball, after the trigger 14 is pulled, the hammer 22 and the firing piston 21 are moved from the first position status to the second position status, and then moved from the second position status to the first position status, so as to complete a stroke. The time required for the hammer 22 and the firing piston 21 to perform the stoke is defined as a cycle time.

In the present invention, the frame 1 includes a delay mechanism 3 configured to extend the cycle of the shooting process. As shown in FIG. 1, the delay mechanism 3 includes an extension tube 30 connected with the frame 1 and in communication with the second operation chamber 12. The extension tube 30 includes a slidable member 31 and a resistance device disposed inside. The slidable member 31 is fixed and connected with the hammer 22 by a second linking member 32, such that the slidable member 31 can be moved simultaneously with the hammer 22 and the firing piston 21. In other words, the three devices are moved simultaneously from the first position status and the second position status for performing the stroke.

Figure 2:
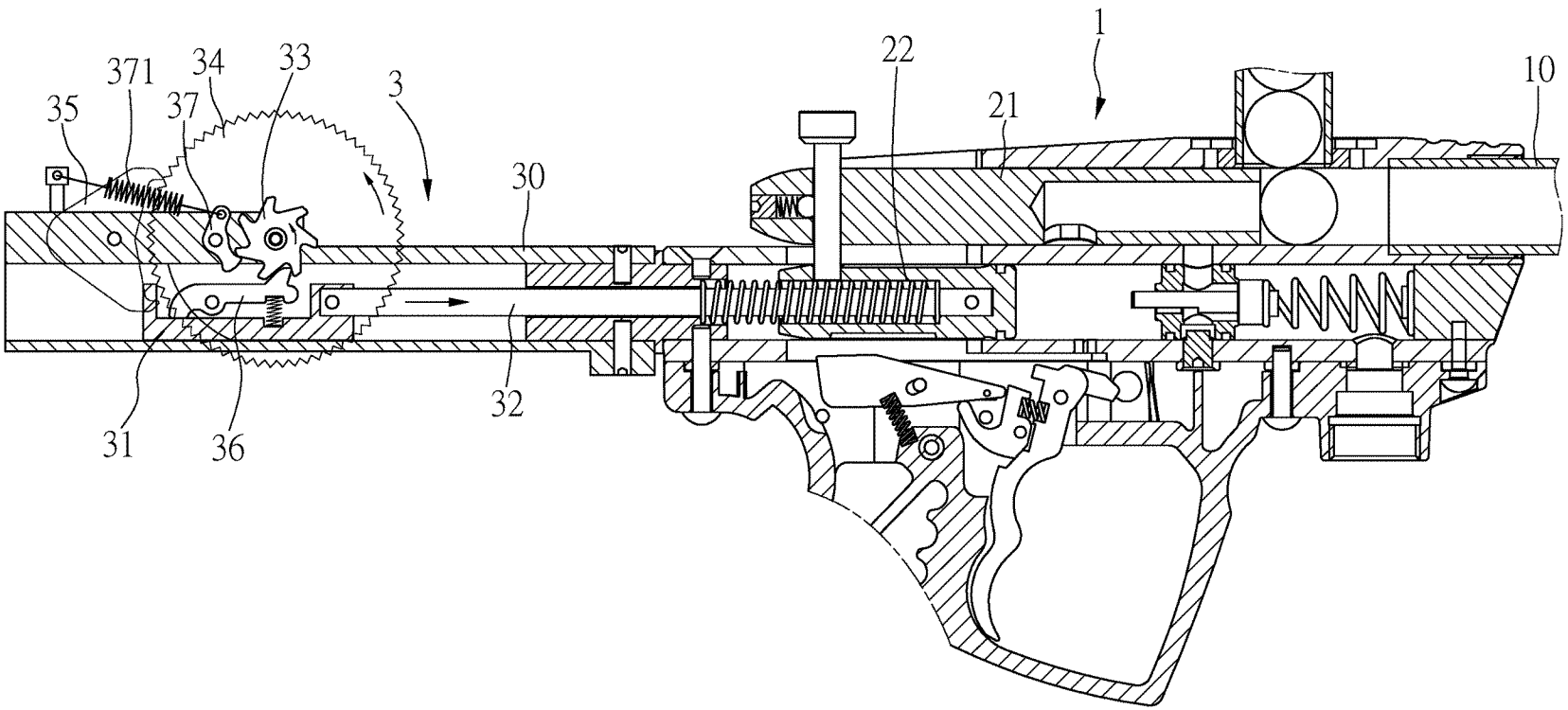
FIG. 2 is a cross-sectional schematic view showing an early-stage operation of the paintball gun of the first embodiment of the present invention, during a shooting process.

The slidable member 31 abuts against the resistance device and the resistance device provides resistance to the slidable member 31, such that all of the slidable member 31, the hammer 22 and the firing piston 21 are moved at a reduced speed in the early-stage when they are in the first position status. In the present embodiment, the resistance device includes a toggle gear 33, a resistance gear 34 and an obstruction member 35. The toggle gear 33 and the resistance gear 34 are disposed coaxially, and the obstruction member 35 abuts against the resistance gear 34 to provide resistance against rotation of the resistance gear 34. The toggle gear 33 is disposed correspondingly in position to the slidable member 31. The slidable member 31 is pivotally linked with a toggle 36 which is elastically pushed by a spring to press against a tooth edge of the toggle gear 33. As shown in FIG. 2, when all of the slidable member 31, the hammer 22 and the firing piston 21 are moved from the first position status to the second position status, the toggle 36 moves with the slidable member 31 to poke the toggle gear 33, and the resistance gear 34 is rotated simultaneously.

Furthermore, in present embodiment, as shown in FIG. 2, the extension tube 30 includes a constraint member 37 which is pulled by a spring 371 to normally lock the toggle gear 33. Under a condition that the slidable member 31 is moved from the first position status to the second position status, the toggle gear 33 can poke the constraint members 37 and be rotated by the toggle 36. However, as shown in FIG. 4, when the slidable member 31 is moved from the second position status to the first position status, the toggle gear 33 fails to reversely rotate because of being locked by the constraint members 37. In other words, the toggle gear 33 can be poked by the toggle member only unidirectionally when the slidable member 31 is moved from the first position status to the second position status.

Figure 5:
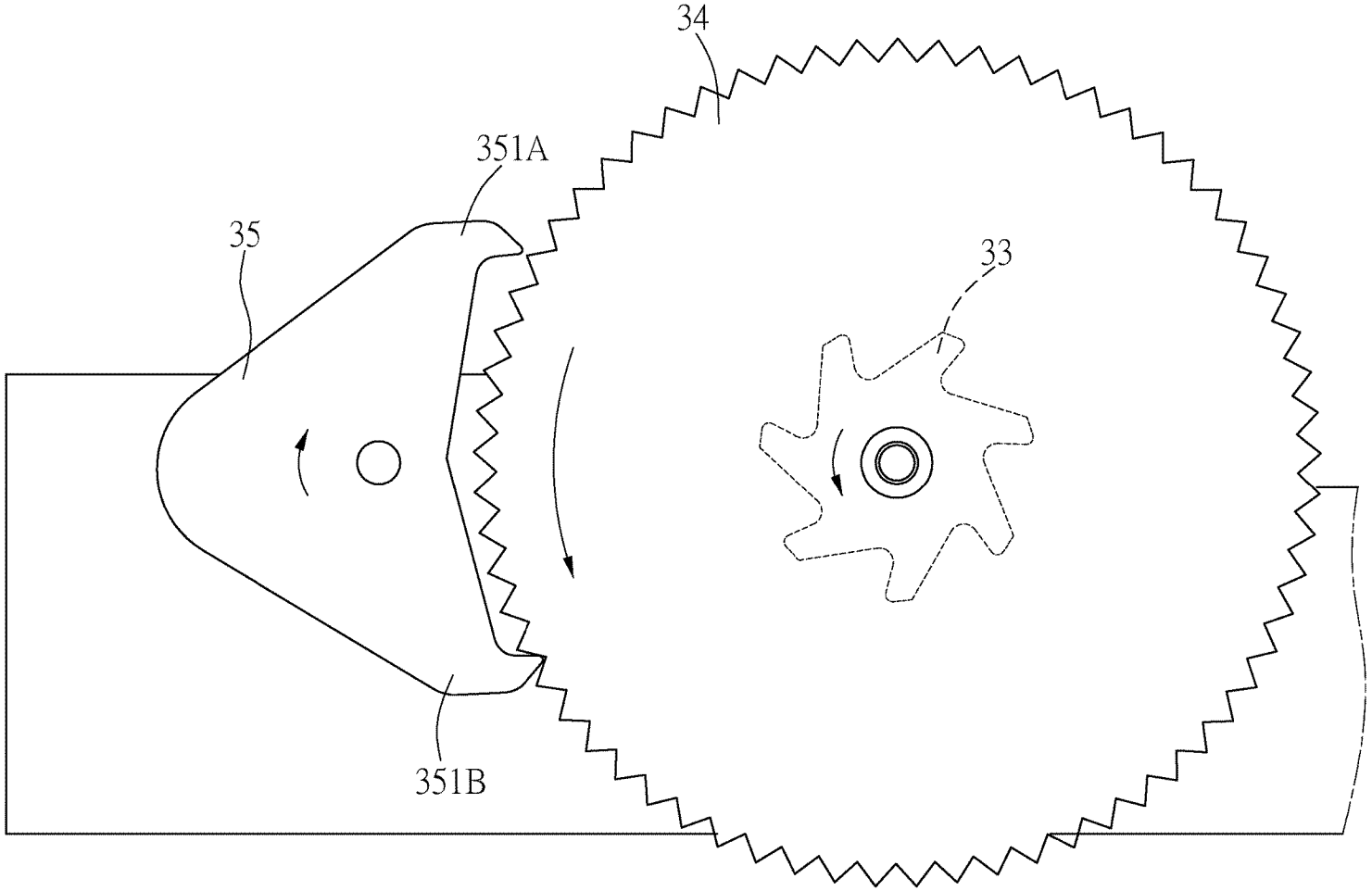
FIG. 5 and FIG. 6 are schematic views showing operation between an obstruction member and a resistance gear of a delay mechanism of the first embodiment of the present invention.
Figure 6:
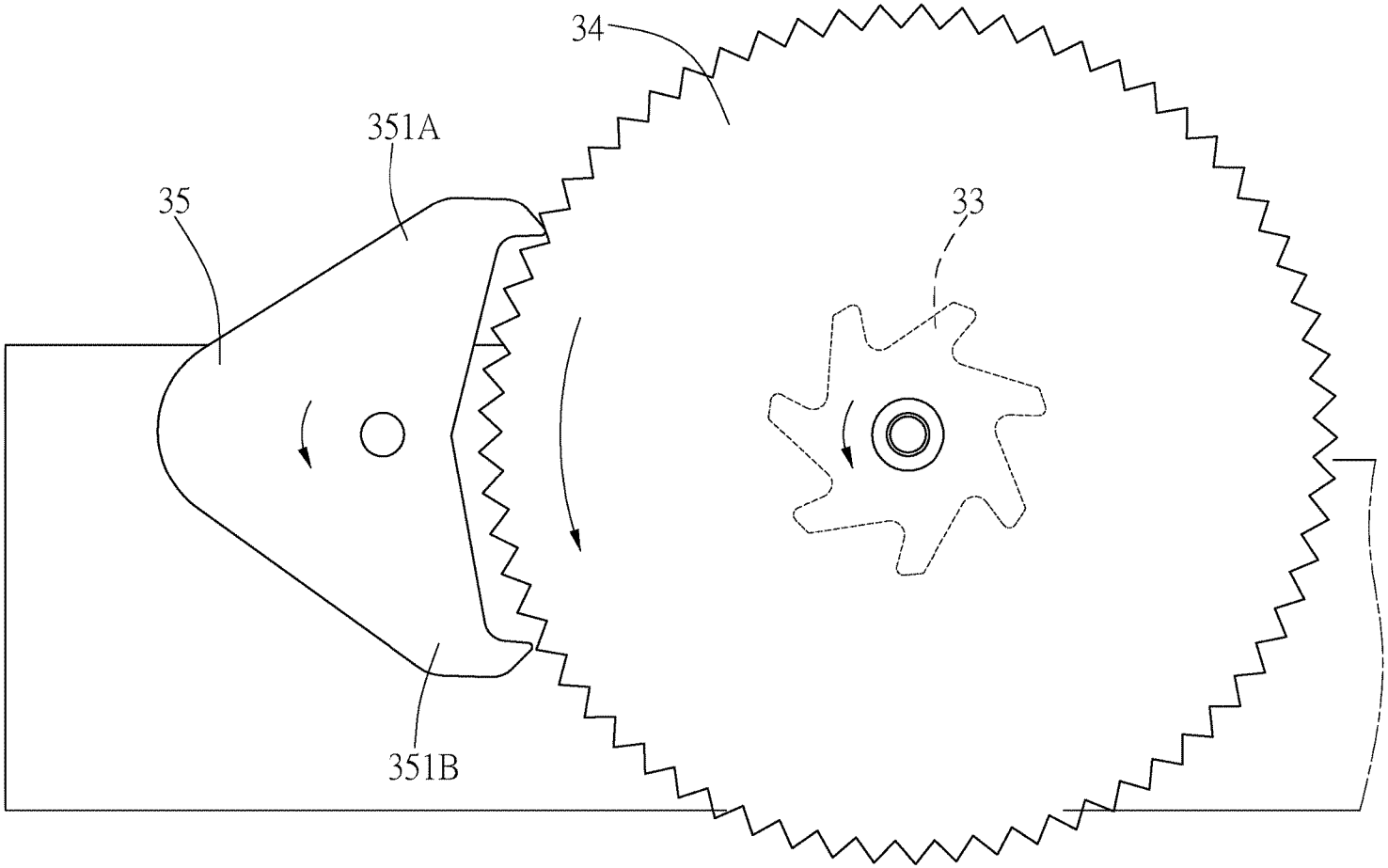

On the other hand, the obstruction member 35, which is pivotally disposed in the extension tube 30, can be pivotally swung back and forth, and the obstruction member 35 has two ends respectively extended to form abutting parts 351A and 351B which are configured to pivotally swing to alternately abut against the tooth edge of the resistance gear 34. Please refer to FIG. 5. The abutting part 351B of the obstruction member 35 is inserted between two teeth of the resistance gear 34. While the resistance gear 34 is rotated, the tooth of the resistance gear 34 pushes the abutting part 351B to pivotally swing the obstruction member 35, such that the abutting part 351B leaves from the resistance gear 34 and the abutting part 351A is then inserted between two teeth of the resistance gear 34, as shown in FIG. 6. Next, the resistance gear 34 keeps rotating, and its tooth is then abutted with and pushes the abutting part 351A to pivotally swing the obstruction member 35 in a reverse direction. As a result, the abutting part 351A leaves away from the resistance gear 34 and the abutting part 351B is then inserted between two teeth of the resistance gear 34, as shown in FIG. 5. The abutting parts 351A and 351B at the two ends of the obstruction member 35 provide resistance to the resistance gear 34 separately, so as to interfere with the rotation of the resistance gear 34 to further slow down the resistance gear 34. The rotational speed of the resistance gear 34 is directly relevant to the velocity in which the slidable member, the hammer and the firing piston perform the stroke, such that the slower rotational speed of the resistance gear 34 can increase the cycle time required for the slidable member, the hammer and the firing piston to perform the stroke.

By means of the delay mechanism 3, the cycle time of the stroke of the hammer 22 and the firing piston 21 can be increased, such that there is enough time for the paintball 5 to enter the percussion zone 151 through the ball feeding hole 15, and then enter the percussion zone 151 before the hammer 22 and the firing piston 21 complete the stroke, thereby ensuring that the problem of jam or breakage of the paintball will not occur while the paintball gun is operated to continuously shoot.

Figure 7:
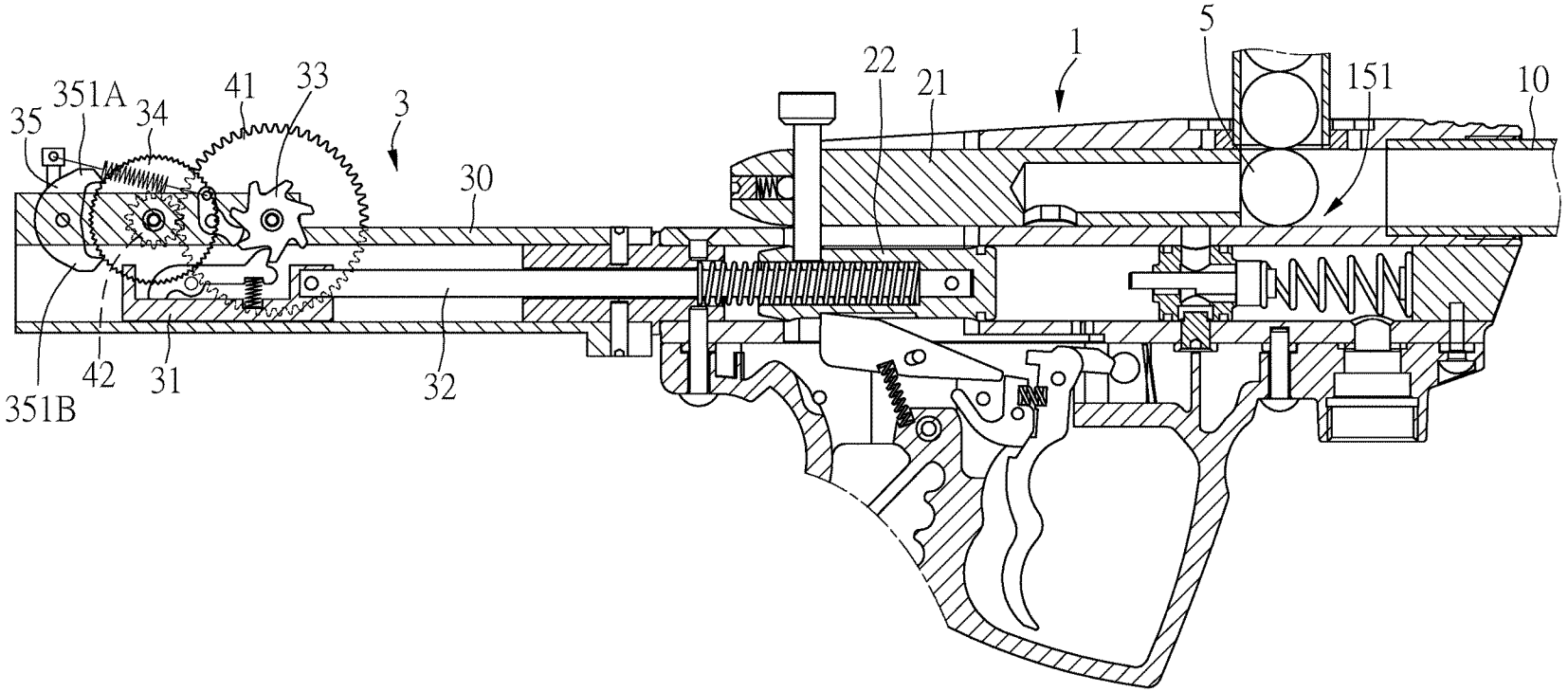
FIG. 7 is a cross-sectional schematic view of a paintball gun according to a second embodiment of the present invention.
Figure 8:
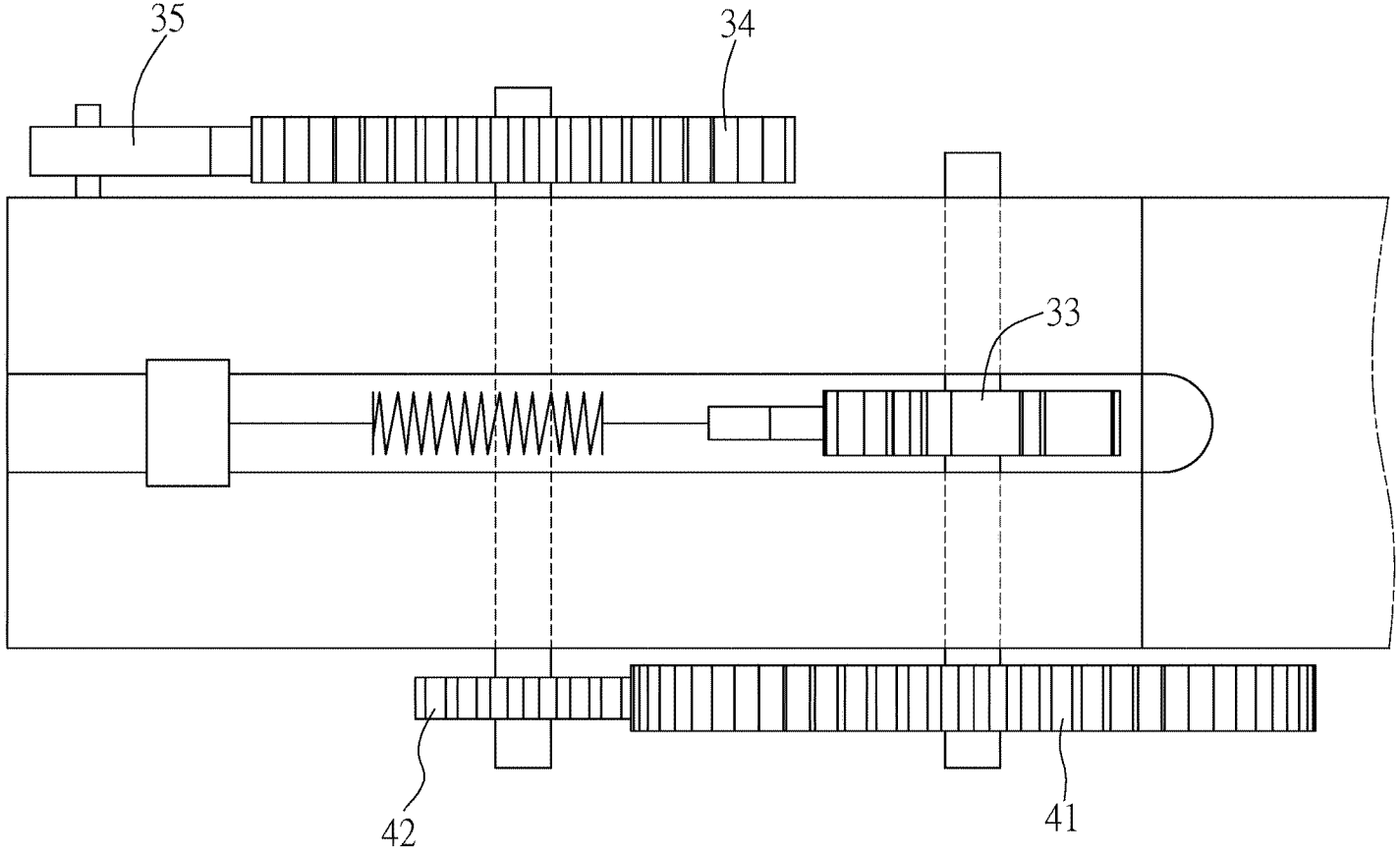
FIG. 8 is a plan view of a delay mechanism of the paintball gun of the second embodiment of the present invention, when viewed from another angle.

FIG. 7 shows a second embodiment of the present invention which is based on the first embodiment. The difference between the second embodiment and the first embodiment is that, in the second embodiment, a transmission gear set is further disposed between the toggle gear 33 and the resistance gear 34. Please refer to FIG. 8. The transmission gear set includes a first gear 41 disposed coaxially with the toggle gear 33, and a second gear 42 disposed coaxially with the resistance gear 34, and the first gear 41 and the second gear 42 are engaged with each other. When the toggle gear 33 is poked because of movement of the slidable member 31, the resistance gear 34 is rotated by transmission between the first gear 41 and the second gear 42. In the present embodiment, the second gear 42 is dimensionally smaller than the first gear 41, so as to speed up the rotation of the resistance gear 34 under the same rotational speed of the toggle gear 33, whereby the resistance gear 34 is interfered by the abutting parts 351A and 351B of the obstruction member 35 in more times. As a result, the obstruction member 35 can provide more resistance to extend the cycle time for the slidable member 31, the hammer 22 and the firing piston 21 to complete the stroke, and there is more time for the paintball 5 to be fed into the percussion zone 151, and the problem of jam or breakage of paintball will not occur while the paintball gun is operated to continuous shoot.

Figure 9:
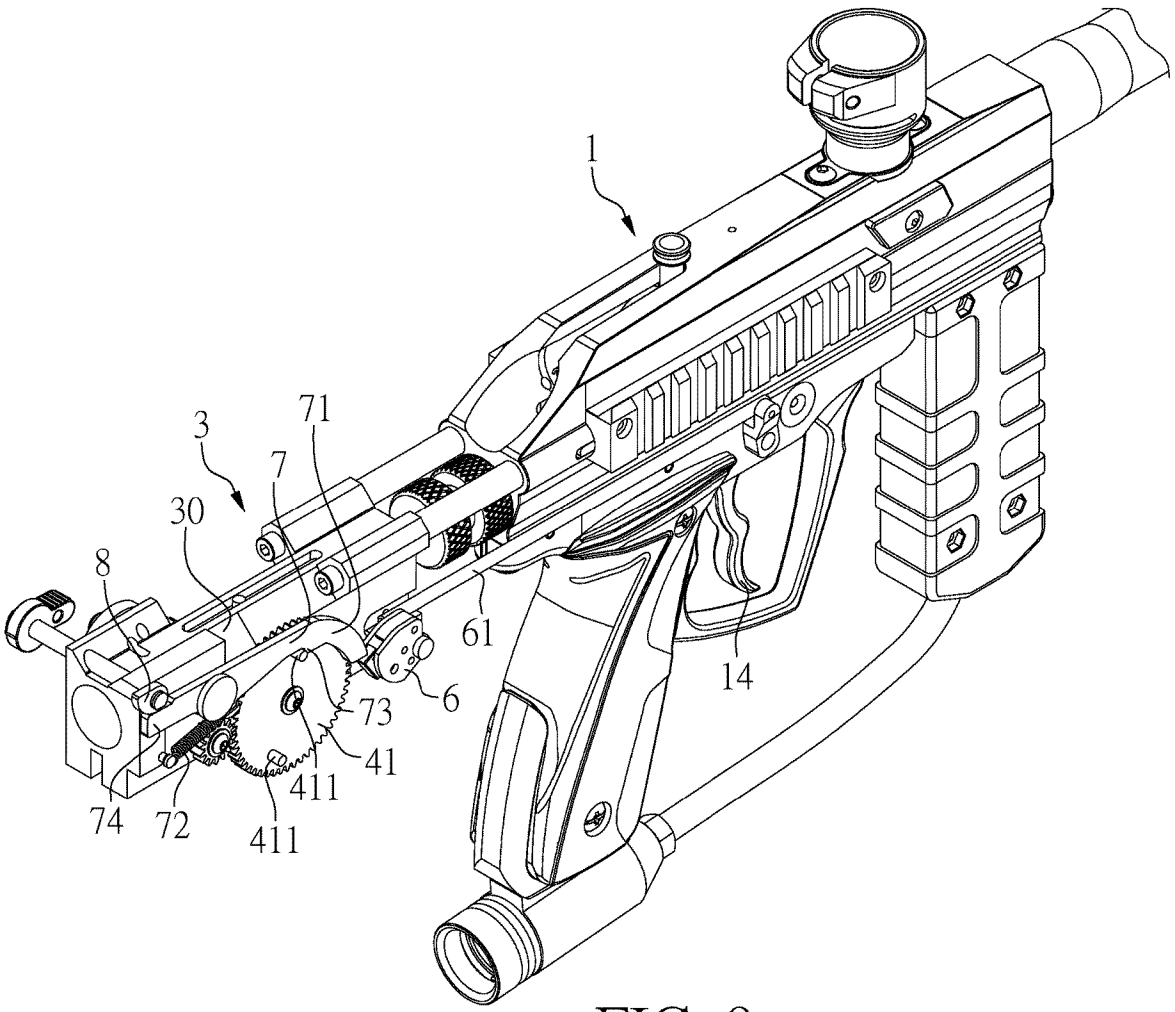
FIG. 9 is a perspective view of a paintball gun according to a third embodiment of the present invention.
Figure 10:
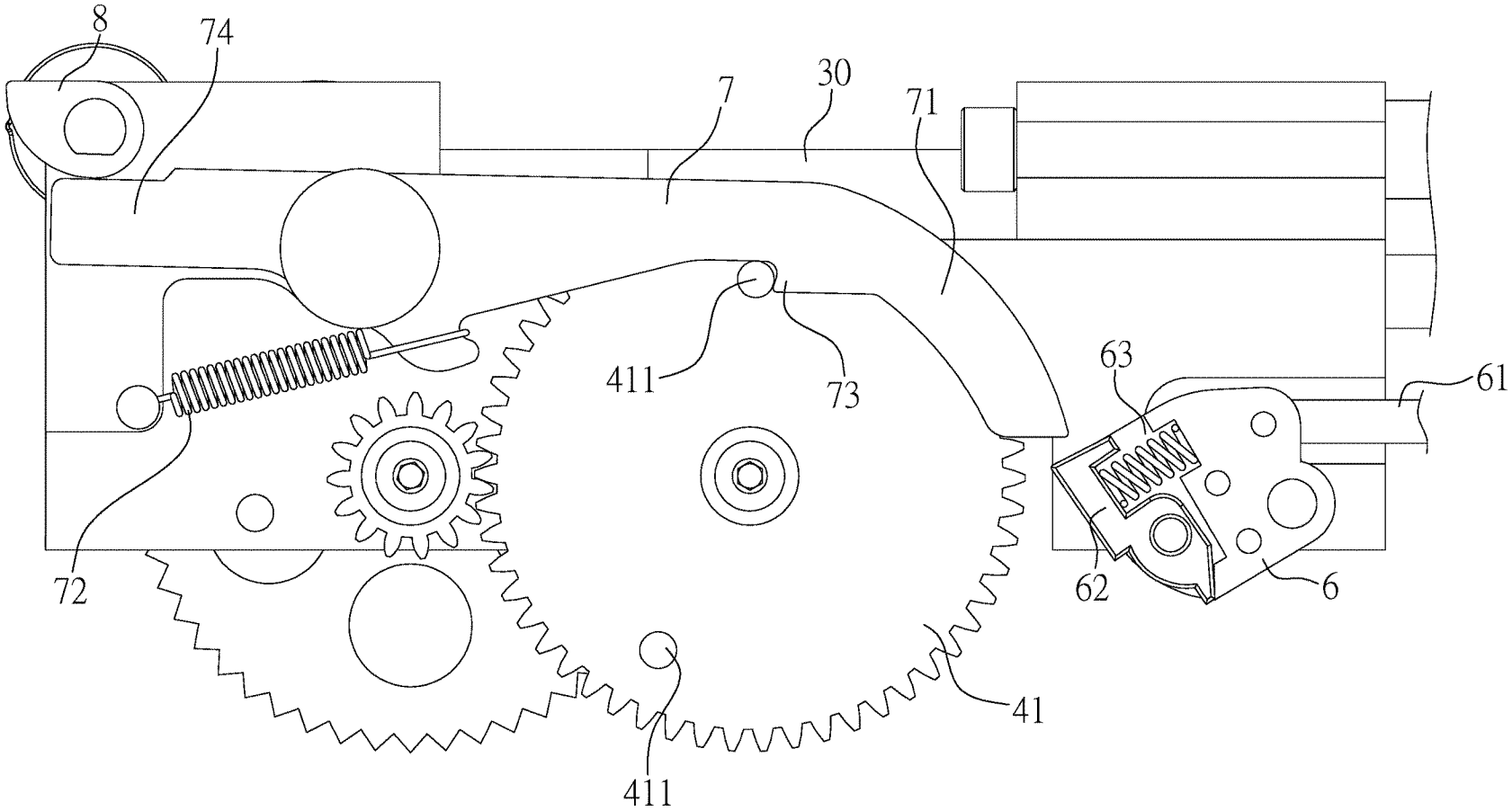
FIG. 10 is a partial schematic view of the paintball gun of the third embodiment of the present invention.

FIG. 9 and FIG. 10 depict the third embodiment of the present invention which is based on the second embodiment. The difference between the third embodiment and the second embodiment is that, in the third embodiment, the delay mechanism 3 is additionally equipped with a structure capable of controlling a number of repetitions of the paintball gun's continuous shooting. The structure includes at least one raised post 411 formed on the face of the first gear 41 to move with the rotation of the first gear 41. The number of and the interval between the raised posts 411 are determined by the desired number of repetitions of the paintball gun's continuous shooting.

Furthermore, the extension tube 30 has its end close to the frame 1 pivotally linked with an auxiliary trigger 6. The auxiliary trigger 6 and the trigger 14 are linked by an interlocking bar 61. The interlocking bar 61 has its two ends pivotally connected to the auxiliary trigger 6 and the trigger 14, respectively, so that when the trigger 14 is pulled, the interlocking bar 61 drives the auxiliary trigger 6 to pivot simultaneously. The auxiliary trigger 6 is provided with a pivotal block 62, whose one end is linked to the auxiliary trigger 6 by a fourth spring 63.

Figure 11:
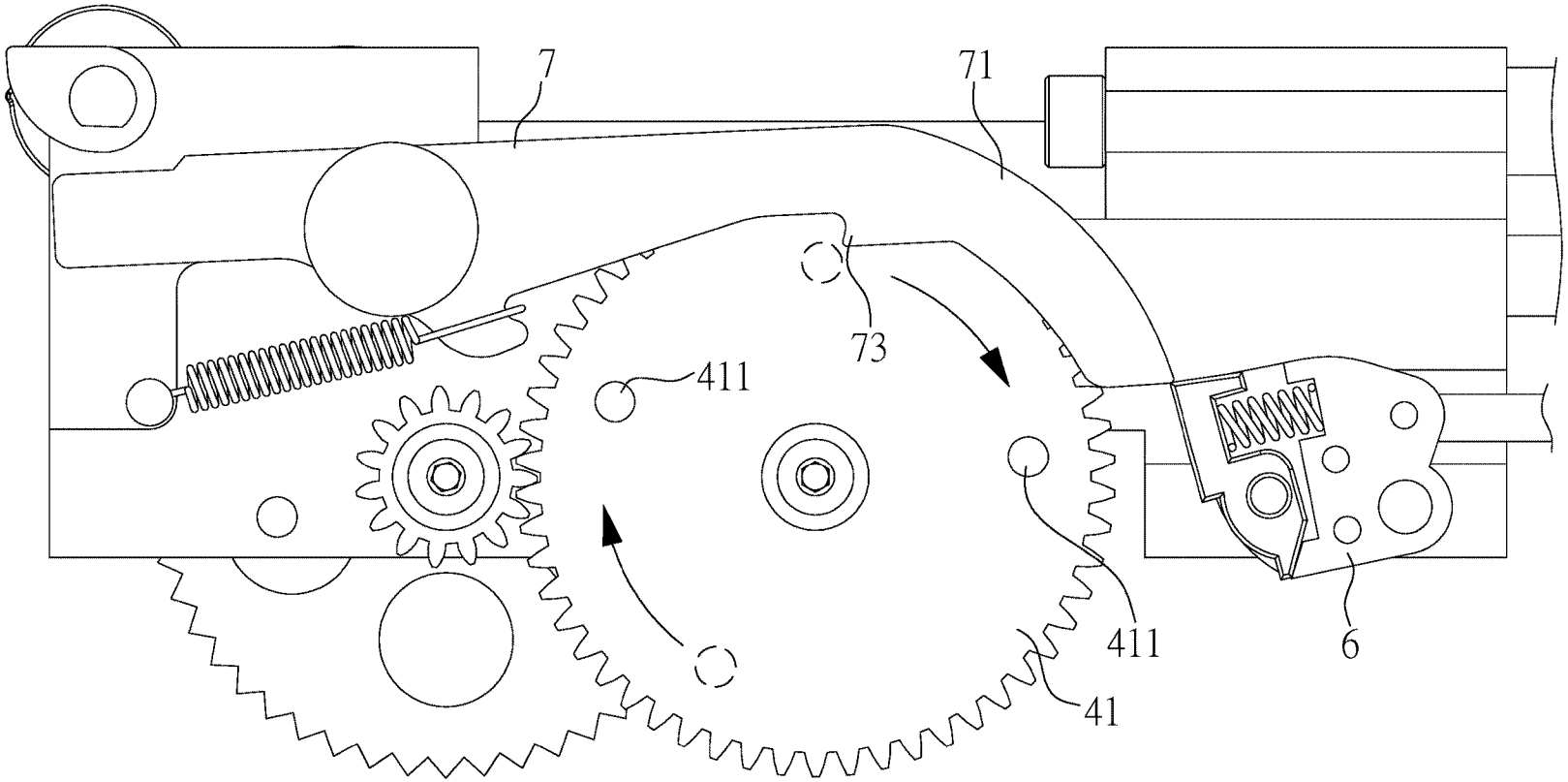
FIG. 11 and FIG. 12 are schematic view showing operation of the paintball gun of the third embodiment of the present invention.

In addition, the extension tube 30 has its end far from the frame 1 pivotally linked with a swing arm 7. The swing arm 7 extends over the side of the first gear 41 having the raised post 411, and has a curved first end 71 extending toward the auxiliary trigger 6. The first end 71 reaches the swing range of the auxiliary trigger 6. When the auxiliary trigger 6 is driven by the interlocking bar 61 to pivot, the first end 71 is pushed by the auxiliary trigger 6 and this makes the swing arm 7 to pivot from a first swing position as shown in FIG. 10 to a second swing position as shown in FIG. 11. Moreover, the extension tube 30 contains a fifth spring 72 connected to the swing arm 7 to draw the swing arm 7 from the second swing position back to the first swing position.

The first end 71 further has a barb-like stopping portion 73. When the swing arm 7 is at the first swing position as shown in FIG. 10, the stopping portion 73 is located in the path of the raised post 411 of the first gear 41. Thus, when the first gear 41 rotates as stated previously, the raised post 411 is stopped by the stopping portion 73 and prevents the first gear 41 from rotation. On the contrary, as shown in FIG. 11, when the swing arm 7 is at the second swing position, the stopping portion 73 gets away from the path of the raised post 411 and forms no obstruction against the raised post 411, so the first gear 41 is allowed to rotate freely.

With the aforementioned configuration of the present embodiment, when the trigger 14 is pulled once, as shown in FIG. 10 and FIG. 11, the auxiliary trigger 6 pivots to drive the first end 71 of the swing arm 7 to move to the second swing position. At this time, the raised post 411 is not stopped by the stopping portion 73, and the first gear 41 can rotate as stated previously, thereby enabling continuous shooting. However, as shown in FIG. 12, the swing arm 7 is immediately drawn by the fifth spring 72 back to the first swing position, so the raised post 411, after having moved with the first gear 41 for a part of its stroke, is stopped by the stopping portion 73 and prevents the first gear 41 from further rotation, thereby ceasing continuous shooting of paintballs.

Thus, one pull of the trigger 14 initiates continuous shooting of paintballs and the continuous shooting terminates when the raised post 411 is stopped by the stopping portion 73, thereby performing continuous shooting with limited repetitions. The part of the rotational stroke performed by the raised post 411 before it is stopped by the stopping portion 73 is in direct proportion with the duration of continuous shooting of paintballs. In other words, the more the raised posts 411 provided on the first gear 41 are, the shorter the rotational stroke of the first gear 41 corresponding to one pulling on the trigger 14 is, and the fewer the paintballs shot by the resulting continuous shooting are.

Figure 12:
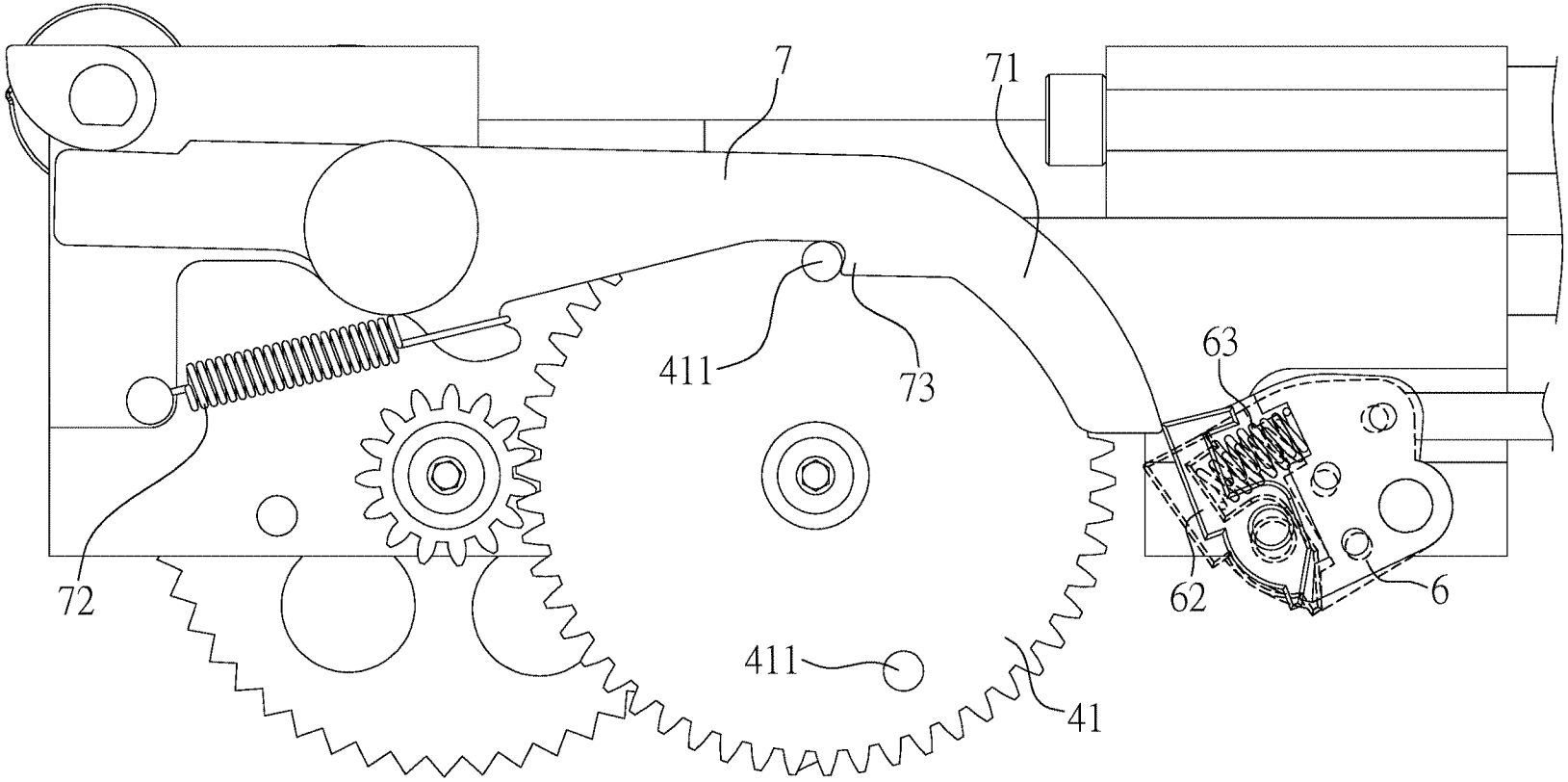

After the trigger 14 is released, as shown in FIG. 12, the auxiliary trigger 6 pivots back so that the pivotal block 62 abuts against the first end 71 of the swing arm 7. At this time, as the auxiliary trigger 6 continues to rotate backward, the pivotal block 62 compress the fourth spring 63 and displace, thereby making the auxiliary trigger 6 pivot back to its initial position as shown in FIG. 10.

Figure 13:
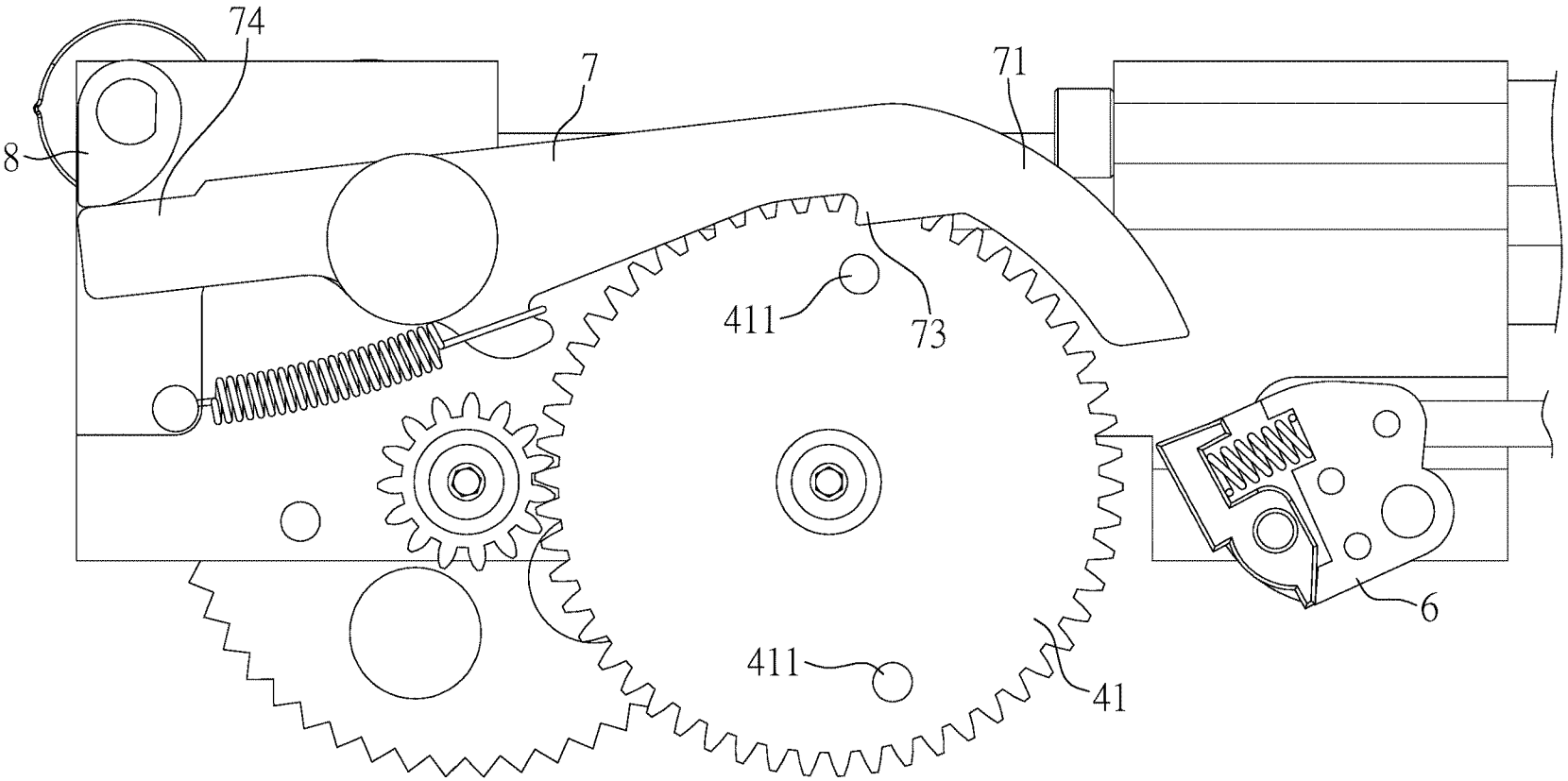
FIG. 13 is a schematic view showing operation of a thumbwheel of the paintball gun of the third embodiment of the present invention.

On the other hand, as shown in FIG. 10, the extension tube 30 has a thumbwheel 8. The swing arm 7 has an extending second end 74 that abuts against the thumbwheel 8. The thumbwheel 8 is formed as a cam, and is configured to push the second end 74 when poked as shown in FIG. 13, so as to make the swing arm 7 move to the second swing position, thereby enabling the paintball gun to perform unlimited continuous shooting. When the thumbwheel 8 is set back to the position as shown in FIG. 10, the paintball gun is set into a mode for limited continuous shooting.

Figure 14:
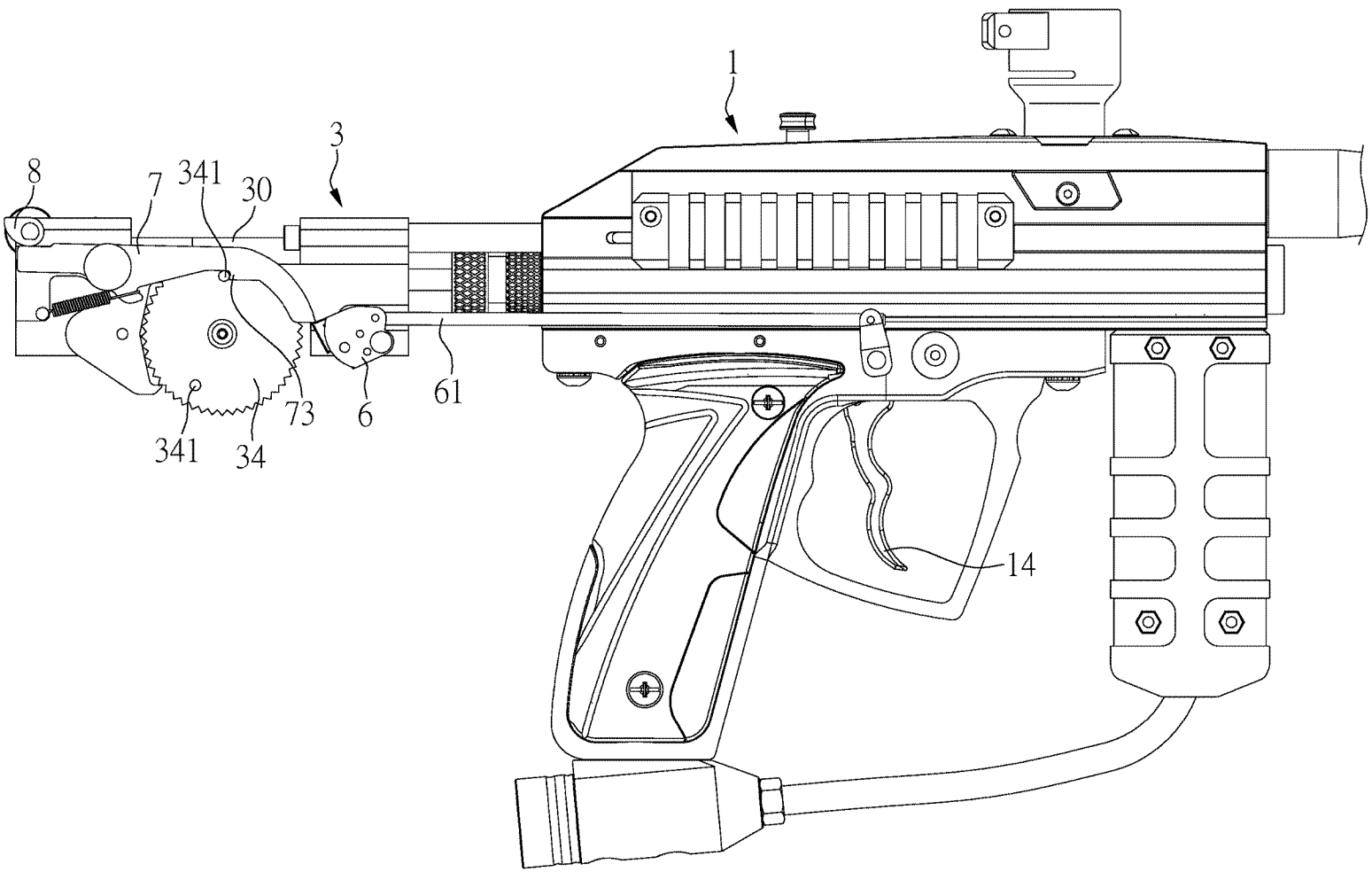
FIG. 14 is a partial schematic view of a paintball gun according to a fourth embodiment of the present invention.
Figure 15:
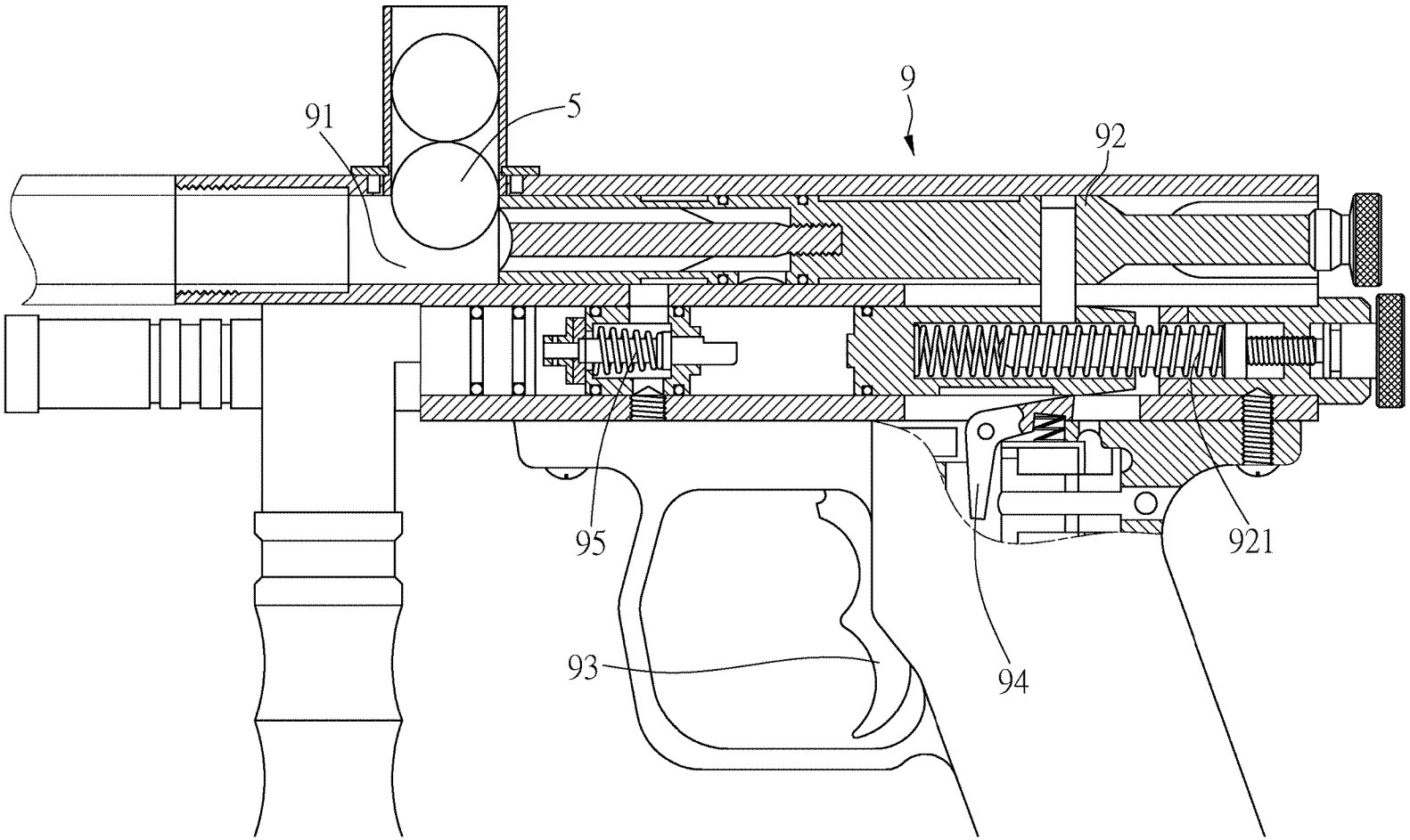
FIG. 15 PRIOR ART
FIG. 15 is a cross-sectional schematic view of a conventional paintball gun.

FIG. 14 shows a fourth embodiment of the present invention, which is based on the first embodiment and has the delay mechanism 3 additionally equipped with the structure capable of controlling a number of repetitions of the paintball gun's continuous shooting. Since the structure used in the present embodiment is structurally and operationally similar to its counterpart as described in the third embodiment with the only difference laying on that the raised post 341 is disposed on the resistance gear 34 instead, repeated description is omitted herein.

What is claimed is:

1. A mechanical paintball gun, comprising a frame including a barrel formed with a first operation chamber and a second operation chamber, a firing piston slidably disposed in the first operation chamber, and a hammer slidably disposed in the second operation chamber and elastically pushed by a spring, the firing piston and the hammer being linked with each other to move simultaneously between a first position status and a second position status; the first operation chamber having a ball feeding hole, and a portion, which corresponds in position to the ball feeding hole, being defined as a percussion zone; the second operation chamber being in communication with a high-pressure gas source and having a valve pack which is normally closed, the valve pack allowing high-pressure gas to pass therethrough when pushed to open by the hammer at the second position status; the frame having a ventilation hole in communication with the first operation chamber and the second operation chamber, the firing piston having an outlet channel, and the outlet channel being in communication with the ventilation hole when the firing piston is at the second position status; the frame including a stop member, which normally locks the hammer at the first position status, and is linked with a trigger, the trigger being pivotally swingable and when swung it separates the stop member from the hammer, thereby relieving the hammer from locking; the mechanical paintball gun being characterized in:

the frame including a delay mechanism configured to increase a cycle time of a shooting process, the delay mechanism including an extension tube corresponding in position to the second operation chamber, a slidable member and a resistance device being disposed in the extension tube, the slidable member being connected with the hammer so that the slidable member and the hammer move simultaneously between the first position status and the second position status, and the slidable member such abutting against the resistance device that the resistance device provides resistance to the slidable member.

2. The mechanical paintball gun according to claim 1, wherein the resistance device comprises:

a toggle gear abutting against a toggle that is pivotally connected with the slidable member and configured to poke the toggle gear according to movement of the slidable member;

a resistance gear linked with the toggle gear and configured to rotate with the toggle gear; and an obstruction member abutting against the resistance gear so as to provide rotational resistance against the resistance gear.

3. The mechanical paintball gun according to claim 2, wherein the obstruction member is pivotally disposed in the extension tube and has two ends thereof each provided with an abutting part, in which the two abutting part are configured to abut against a tooth edge of the resistance gear alternately while the obstruction member is pivotally swung.

4. The mechanical paintball gun according to claim 2, wherein the toggle gear and the resistance gear are disposed coaxially.

5. The mechanical paintball gun according to claim 2, wherein a constraint member is disposed in the extension tube and configured to lock the toggle gear, such that the toggle gear is poked by the toggle just unidirectionally when the slidable member is moved from the first position status to the second position status.

6. The mechanical paintball gun according to claim 2, further comprising:

at least one raised post disposed on the resistance gear;

an auxiliary trigger pivotally disposed in the extension tube and having an interlocking bar linked to the trigger; and a swing arm pivotally disposed in the extension tube and having a first end thereof extending toward the auxiliary trigger, the first end being configured to be pushed by the auxiliary trigger and in turn make the swing arm swing between a first swing position and a second swing position; the first end having a stopping portion, when the swing arm is at the first swing position, the stopping portion stopping the raised post and limiting a rotational stroke of the resistance gear, and when the swing arm is at the second swing position, the stopping portion forming no obstruction against the raised post.

7. The mechanical paintball gun according to claim 6, wherein the first end of the swing arm is curved and the stopping portion is barb-like.

8. The mechanical paintball gun according to claim 6, wherein a spring disposed in the extension tube is linked with the swing arm for drawing the swing arm from the second swing position back to the first swing position.

9. The mechanical paintball gun according to claim 6, wherein a thumbwheel is disposed on the extension tube, and the swing arm has a second end extending to abut against the thumbwheel, so that when operated, the thumbwheel controls the second end to make the swing arm move toward the first swing position or the second swing position.

10. The mechanical paintball gun according to claim 2, wherein the toggle gear and the resistance gear are linked by a transmission gear set that comprises a first gear disposed coaxially with the toggle gear, and a second gear disposed coaxially with the resistance gear, in which the first gear and the second gear are engaged with each other.

11. The mechanical paintball gun according to claim 10, wherein the second gear is dimensionally smaller than the first gear.

12. The mechanical paintball gun according to claim 10, further comprising:

at least one raised post disposed on the first gear;

an auxiliary trigger pivotally disposed in the extension tube and having an interlocking bar linked to the trigger; and a swing arm pivotally disposed in the extension tube and having a first end thereof extending toward the auxiliary trigger, the first end being configured to be pushed by the auxiliary trigger and in turn make the swing arm swing between a first swing position and a second swing position; the first end having a stopping portion, when the swing arm is at the first swing position, the stopping portion stopping the raised post and limiting a rotational stroke of the first gear; and when the swing arm is at the second swing position, the stopping portion forming no obstruction against the raised post.

13. The mechanical paintball gun according to claim 12, wherein the first end of the swing arm is curved and the stopping portion is barb-like.

14. The mechanical paintball gun according to claim 12, wherein a spring disposed in the extension tube is linked with the swing arm for drawing the swing arm from the second swing position back to the first swing position.

15. The mechanical paintball gun according to claim 12, wherein a thumbwheel is disposed on the extension tube, and the swing arm has a second end extending to abut against the thumbwheel, so that when operated, the thumbwheel controls the second end to make the swing arm move toward the first swing position or the second swing position.

* * * * *